United States Patent [19]

Wilson

[11] 4,295,516

[45] Oct. 20, 1981

[54] SYMMETRICAL HORIZONTAL CONTINUOUS CASTING

[75] Inventor: Robert Wilson, Dundee, Scotland

[73] Assignee: Timex Corporation, Waterbury, Conn.

[21] Appl. No.: 101,389

[22] Filed: Dec. 7, 1979

Related U.S. Application Data

[63] Continuation-in-part of Ser. No. 958,774, Nov. 8, 1978, Pat. No. 4,216,818.

[51] Int. Cl.[3] ..... B22D 11/124; B22D 11/00

[52] U.S. Cl. ..... 164/464; 164/443; 164/485; 164/421

[58] Field of Search ..... 164/89, 443, 444, 118, 164/297, 348, 126, 128, 82, 418, 85, 421

[56] References Cited

U.S. PATENT DOCUMENTS

| | | | |
|---|---|---|---|
| 3,578,065 | 5/1971 | Langer | 164/85 X |
| 3,667,248 | 6/1972 | Carlson | 164/128 X |
| 3,736,979 | 6/1973 | Krall et al. | 164/85 X |
| 4,216,818 | 8/1980 | Wilson | 164/443 |

FOREIGN PATENT DOCUMENTS

| | | | |
|---|---|---|---|
| 1303210 | 6/1971 | Fed. Rep. of Germany | 164/443 |

*Primary Examiner*—Robert D. Baldwin
*Assistant Examiner*—K. Y. Lin
*Attorney, Agent, or Firm*—Edward J. Timmer

[57] ABSTRACT

Both the position and shape of the solidification front in molten metal passing continuously through the horizontal solidification chamber of a mold body are precisely controlled in the invention by establishing a cooling probe insertion pattern in which some of the probes are inserted into cooling bores in the mold body to greater distances than others. Specifically, establishment of a solidification front characterized by a liquid/solid isotherm that is substantially symmetrical across the chamber is achieved by progressively increasing the cooling probe insertion distance from the bottom to the top of the mold body. Premature, asymmetrical solidification on the bottom of the chamber is effectively minimized and reduces hot tears, fissures and other surface defects in the casting.

16 Claims, 11 Drawing Figures

SYMMETRICAL HORIZONTAL CONTINUOUS CASTING

This application is a continuation-in-part of U.S. Ser. No. 958,774 filed Nov. 8, 1978 now U.S. Pat. No. 4,216,818.

FIELD OF THE INVENTION

The present invention relates to horizontal continuous casting processes and apparatus for metals and alloys.

DESCRIPTION OF THE PRIOR ART

The above-referenced U.S. patent application discloses a mold assembly characterized by efficient and controlled heat removal from molten metal during continuous casting. The mold assembly includes a refactory mold body such as graphite having a longitudinal solidification chamber therein and a plurality of longitudinal cooling bores spaced around the solidification chamber. The cooling bores extend only partially through the mold body to define an insulating section adjacent the inlet end thereof to minimize heat removal from the molten metal source and a peripheral cooling section adjacent the outlet end where cooling probes containing a circulating coolant are inserted into the cooling bores. The cooling probes are adjustable along the length of the cooling bores to accurately control the position of the solidification front and provide optimum heat transfer from the molten metal for efficient solidification.

The mold assembly is illustrated as being especially useful in the horizontal continuous casting of molten metals and alloys. A disadvantage with horizontal continuous casting in the past has been asymmetry associated with the development of the solidification front. This asymmetry typically is present in the form of solidification occurring initially adjacent the bottom surface of the solidification chamber and subsequently at the top surface so that the profile of the solidification front slopes backwards from the bottom surface to the top surface of the chamber. This phenomenon is deleterious to the quality of the cast product since hot tears and fissures tend to form on the lower casting surface as a result of the solidified metal shell forming first adjacent the bottom surface of the solidification chamber and then being subjected upon further casting to excessive loads which exceed the hot tensile strength of the shell. The mechanism of asymmetric solidification during horizontal continuous casting is described in greater detail in the Hadden and Indyk article "Heat-transfer Characteristics In Closed Head Horizontal Continuous Casting", in Book 192, The Metals Society, London, pp. 250–255 (1979).

SUMMARY OF THE INVENTION

An important object of the present invention is to provide a horizontal continuous casting process and apparatus in which solidification of the molten metal occurs substantially symmetrically with respect to the top and bottom of the mold solidification chamber.

Another object of the invention is a horizontal continuous casting process and apparatus for producing a casting exhibiting a superior as-cast surface characterized by a substantial reduction in hot tears, fissures and other defects.

Still another object of the invention is a horizontal continuous casting process and apparatus for producing a casting exhibiting an improved microstructure having more uniform grain structure, composition and mechanical properties.

The horizontal continuous casting process of the invention utilizes the basic mold assembly described in the aforementioned copending U.S. patent application, now U.S. Pat. No. 4,216,818 the teachings of which are incorporated by reference herein. An important feature of the present invention involves the discovery that not only the position but also the shape of the solidification front in the molten metal can be varied by establishing a cooling probe insertion pattern in which some of the cooling probes are inserted into the cooling bores in the mold body to greater distances than others. In particular, Applicant has discovered that by inserting the cooling probes into the cooling bores such that the probe insertion distance in the bores increases from the bottom to the top of the mold body that a solidification front can be established transversely across the chamber which intersects the top and bottom of the chamber at approximately the same location along the length of the chamber; i.e. the liquid/solid isotherm intersects the top and bottom of the chamber in substantially the same vertical transverse plane. Of course, this means that solidification at the top and bottom of the chamber occurs approximately simultaneously with no premature, asymmetric solidification of the bottom portion ahead of the top portion of metal. Typically, the aforementioned probe insertion pattern results in the formation of a solidification front having a liquid/solid isotherm that is substantially symmetrical relative to a central longitudinal axis through the solidification chamber. For example, for cylindrical castings such as bars or rods, the symmetrical solidification front takes the form of a generally annular profile of solidified metal around a circular core of molten metal. The horizontal continuous casting process and apparatus of the invention thus can provide almost ideally uniform circumferential or radial cooling and solidification of the molten charge as it passes through the cooling section of the mold body and, as a result, produces a cast product with a superior as-cast surface and microstructure.

Furthermore, difficulties experienced by prior art workers in the horizontal continuous casting of strip, especially nonferrous strip, and hollow shapes such as tubes are readily overcome in preferred embodiments of the present invention.

DESCRIPTION OF THE PREFERRED EMBODIMENTS

Figure 1:
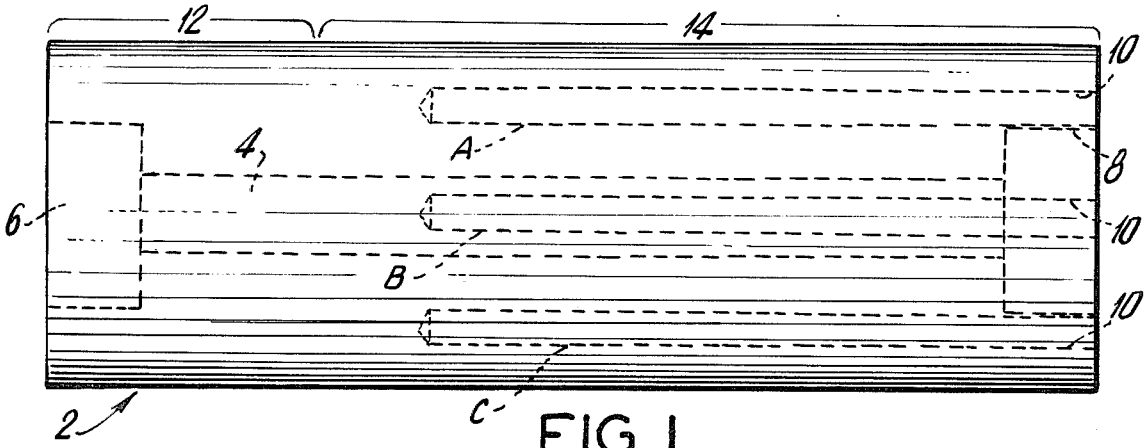
FIG. 1 is a side elevation of a mold body useful in the invention.
Figure 2:
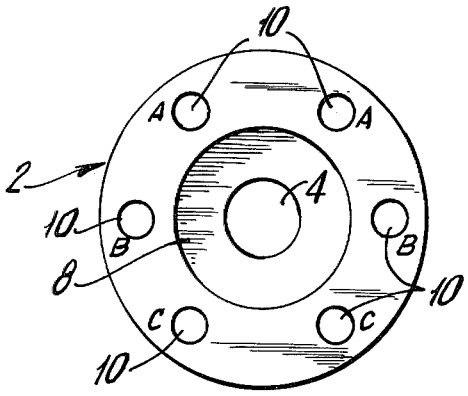
FIG. 2 is an end elevation showing the outlet end of the mold body of FIG. 1.
Figure 5:
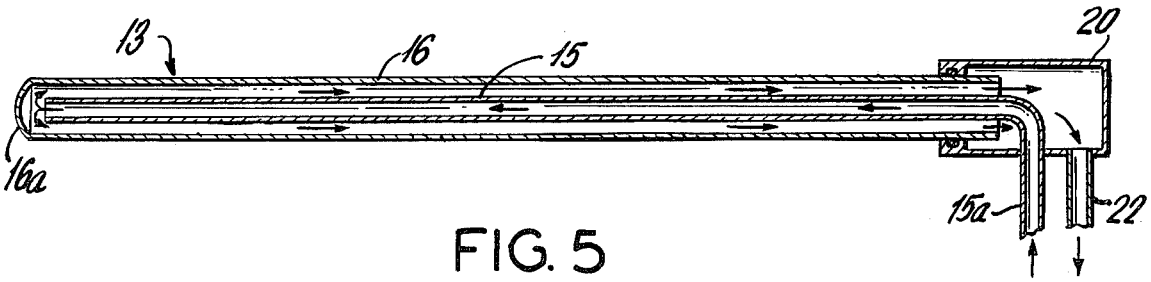
FIG. 5 is a cross-sectional view of a cooling probe.

FIGS. 1, 2 and 5 show the basic mold casting assembly which includes a graphite or other refractory horizontal mold body 2 having a central cylindrical bore therethrough which defines a cylindrical solidification chamber 4 for producing a cast bar product. The bore includes enlarged ends one of which defines inlet end 6 through which molten metal enters the chamber and outlet end 8 through which the solidified product exits. Inlet end 6 is connected to the discharge nozzle of a crucible (not shown) or other vessel containing molten metal to be continuously cast. Spaced around the periphery of the solidification chamber 4 are a plurality of parallel cylindrical cooling bores 10 which have an open end at the outlet end of the mold body and extend partially into the mold body in the direction of the inlet end to provide a peripheral insulating section 12 adjacent the inlet end and a peripheral cooling section 14 adjacent the outlet end. As shown in FIG. 2, six cooling bores are spaced 60° apart around the circumference of the solidification chamber. The insulating section is important to minimize heat removal from the crucible and molten metal until it reaches the vicinity of the cooling section. Cooling section 14 provides highly efficient, concentrated and, importantly, highly controllable heat removal from the molten metal passing therethrough when the cooling probes are inserted in cooling bores 10 as described below.

Figure 4:
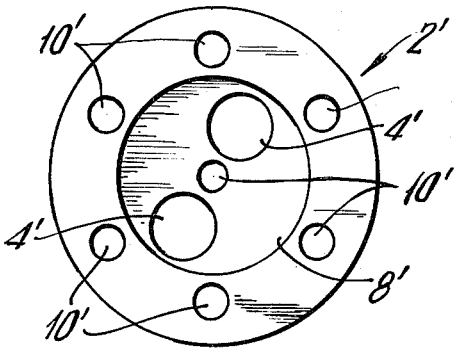
FIG. 4 is an end elevation showing the outlet end of the mold body of FIG. 3.
Figure 3:
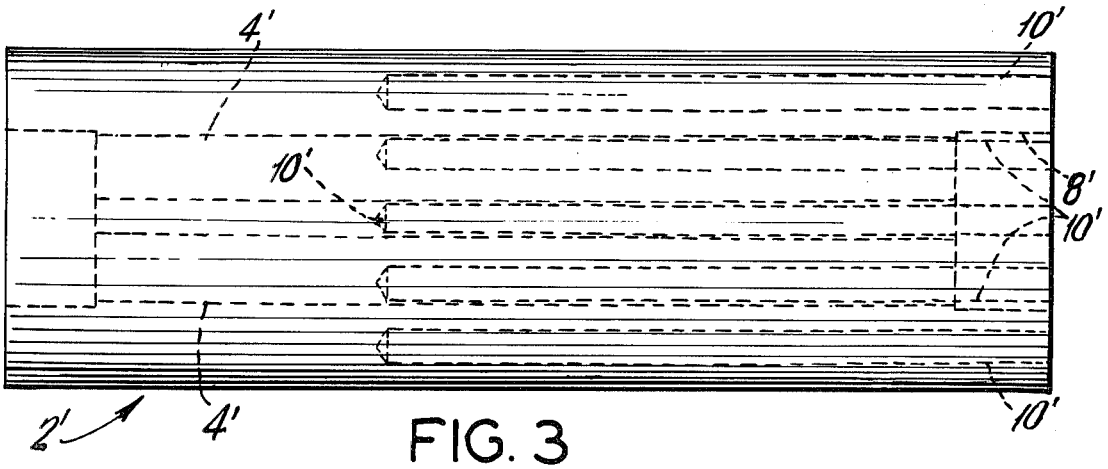
FIG. 3 is a side elevation of another mold body useful in the invention for producing two cast products simultaneously.

FIGS. 3 and 4 illustrate another mold body 2' adapted to cast two bar products through dual horizontal longitudinal solidification chambers 4'. Central cooling bore 10' is provided in addition to those around the circumference of the mold body to insure effective peripheral cooling. The other features and functions of the mold body 2' are the same as those described above with respect to FIGS. 1 and 2.

A typical cooling probe 13 for use in conjunction with the mold body of the above figures is shown in cross-section in FIG. 5 as comprising essentially an inner feed tube 15 and concentric outer return tube 16 inside of which coolant, such as water, circulates as indicated by the arrows. As can be seen, the outer return tube 16 includes a closed end 16*a* to seal one end of the cooling probe. At the other end, the tubes penetrate and are sealed within a manifold 20. Feed tube 15 includes an extension 15*a* passing outside the manifold for connection to a coolant supply whereas outer return tube 16 has an open end inside the manifold for discharging the returning coolant therein. Discharge tube 22 conveys the returning coolant from the manifold for cooling and recycling or for disposal. Preferably, feed and return tubes 15 and 16 are made of highly heat conductive metal such as copper.

To optimize heat transfer from the mold body to the cooling probes, the dimensions of the cooling bores and probes must be properly correlated. Cooling bores 10 mm in diameter and cooling probes having a nominal outer diameter (copper return tube outer diameter) of 10 mm have proved satisfactory in this regard. Great care is used in reaming out the cooling bores in the mold body and the outer surface of each cooling probe is coated with colloidal graphite to provide good contact between the cooling probe and cooling bore wall. Of course, these dimensions can be varied depending upon the size of mold body employed. The aforementioned dimensions have been employed with a cylindrical mold body having a length of 292 mm and a diameter of 90 mm, the solidification chamber(s) having a diameter of 21.26 mm for the single product mold and 15.45 mm for the dual product mold.

Figure 6:
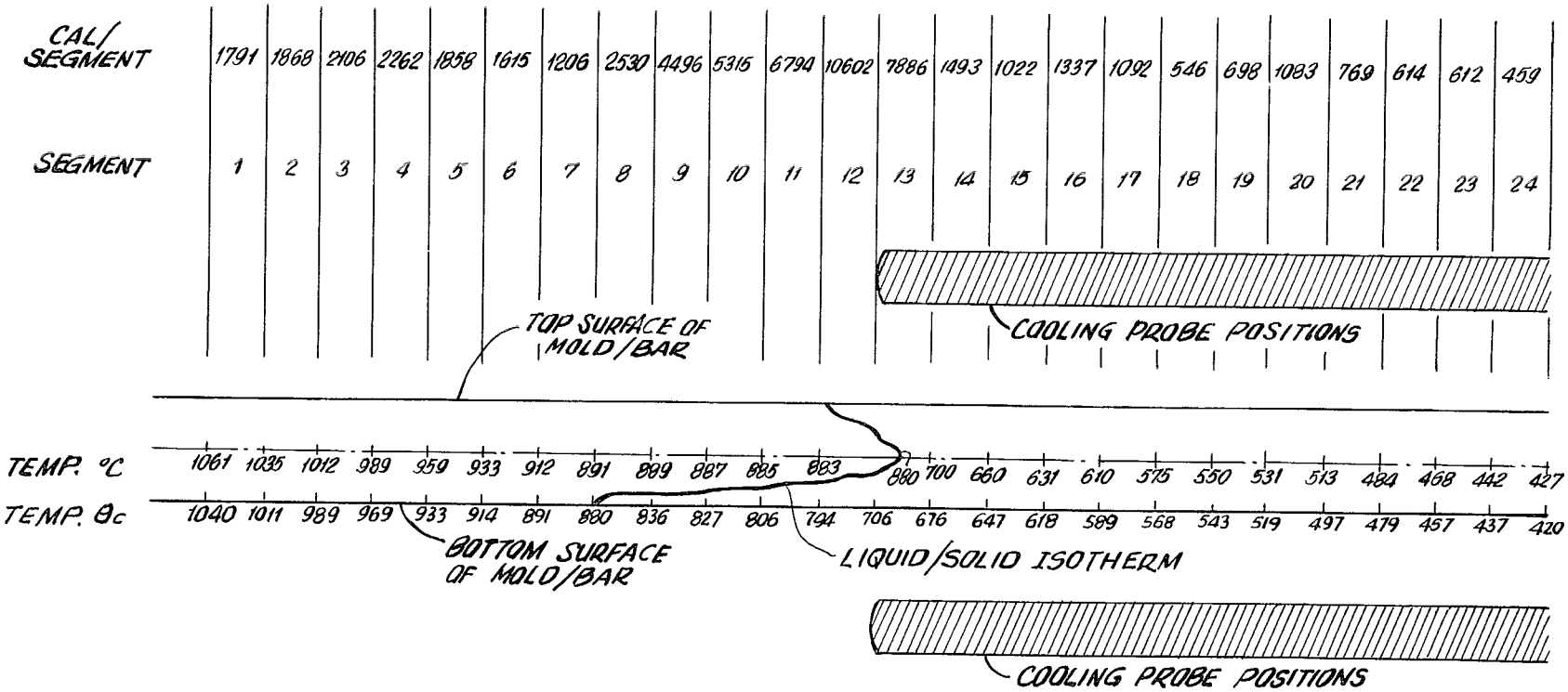
FIG. 6 shows the heat removal pattern, temperature profile and liquid/solid isotherm through molten metal in a mold body like that of FIG. 1 during a typical casting run when the cooling probes are all inserted to 12 cm.

FIG. 6 illustrates graphically the results of casting a leaded brass alloy (International Copper Research Spec. CuZn39Pb2 which solidifies at about 870°–880° C.) through the single product mold (FIG. 1) wherein each cooling probe was inserted 12 cm into its cooling bore and the casting speed was 44 cm/min. Heat removal from the molten metal along the length of the solidification chamber was calculated for each of the 24 cm segments along the bar by the equation:

$$\text{calories/segment} = \frac{a\ 2\pi L \Delta\theta}{\ln r}$$

where a is thermal conductivity in c.g.s. units
where

L = length of segment in centimeters.

$\Delta\theta$ = temperature difference center to surface of liquid or solid metal contained within mold.

ln r = natural logarithm of radius of ingot or bore of mold.

Temperatures along the length of the solidification chamber were determined by thermocouples. While the liquid/solid isotherm profile was determined by injecting a 50/50% tin/indium alloy into the stream of molten metal fairly close to the solidification front so that it would highlight the liquid sump after casting. After casting an appropriate length of bar, the bar was cut in half through the vertical diameter to reveal the shape of the liquid/solid isotherm from top to bottom. Further, after metallographic examination, the cast bar sample was irradiated to impart very high radioactivity level to the indium and autoradiographs were then taken. The samples were also examined by neturon radiographic techniques.

Certain important features are evident from FIG. 6. For example, heat removal in terms of calories removed per segment is relatively low at around 1400 to 2000 calories for segments 1–7. Then, as the molten metal approaches the tips of the cooling probes and the metal in the bottom of the chamber begins to solidify, heat removal increases to 2500 calories in segment 8 (where initial solidification begins), to 10,600 calories at segment 12 (corresponding to the probe tips) and decreases to 7,800 calories one centimeter past the probe tip and thereafter drops off rapidly. The heat removal values thus give an indication of the extreme efficiency of cooling with the basic mold assembly. Heat removal is highly concentrated in location around the probe tips so that control over the solidification process is greatly facilitated, fluidity of the preceding molten metal charge can be maintained and heat losses from the metal in the furnace crucible in particular can be minimized.

Furthermore, it is evident from FIG. 6 that solidification commences on the bottom surface of the mold body some 4 cm ahead of solidification on the top surface. The liquid/solid 880° C. isotherm clearly shows the asymmetrical nature of solidification in the horizontal chamber. This graphical data thus corresponds to prior art experiences with horizontal continuous casting. The top and bottom molten metal temperature values also show the nature of asymmetrical solidification. Although it has been found that solidification of this type in the basic mold assembly produces a satisfactory product, it has nevertheless been desirable to further optimize the horizontal continuous casting process, specifically to provide a process and apparatus capable of horizontal continuous casting wherein the solidification front assumes a generally symmetrical profile and results in a cast product with even better properties, especially as-cast surface finish.

Figure 7:
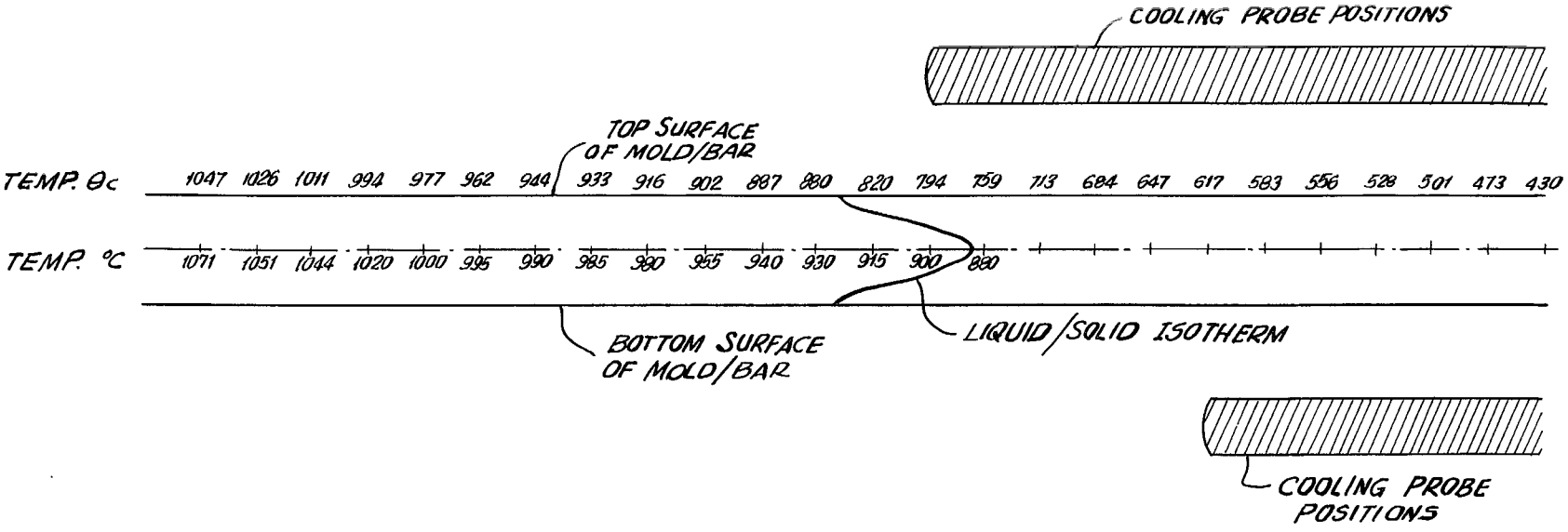
FIG. 7 shows the temperature profile and liquid/solid isotherm through a mold body like that of FIG. 1 during a typical casting run when cooling probes are inserted to progressively increasing distances from the bottom to the top of the mold body.

As shown in FIG. 7, this objective is achieved in accordance with the present invention by suitable adjustment to the relative positions of the cooling probes in the cooling bores. In the Figure, a substantially symmetrical liquid/solid isotherm (880° C.) was established by inserting top, coplanar cooling probes A—A 11 cm into the respective bores, middle, coplanar cooling probes B—B 8 cm and bottom coplanar cooling probes C—C 6 cm (see FIG. 1). The liquid/solid front established transversely across the chamber intersects the top and bottom of the chamber at about the same location along its length (i.e. almost in the same vertical plane) and furthermore is substantially symmetrical to the central, longitudinal axis through the chamber. When viewed in end cross-section, e.g. normal to plane Y, the solidification front takes the form of an annulus of solidified metal surrounding a circular core of molten metal. As a result of this ideal radial cooling and symmetrical solidification, the tendency of the bottom bar surface or shell to hot tear and fissure is greatly reduced and results in a superior as-cast surface compared to an asymmetrically solidified bar. Furthermore, the almost pure radial cooling also promotes a refined grain structure and overall improved microstructure with more homogenous properties and composition throughout the length of the casting.

The control over the solidification process with the present invention is so fine that it is possible to cause solidification to occur first on the top surface of the mold rather than on the bottom or in the symmetrical mode. For example, under similar conditions as above with a casting speed of 29 cm/min, solidification on the top mold surface first was achieved with cooling probes A—A inserted 12 cm, probes B—B 9 cm and probes C—C 7 cm. In this case, the top surface solidified about 10 mm ahead of the bottom surface. However, when the cooling probes were readjusted with probes A—A inserted 12 cm, probes B—B 10 cm and probes C—C 9 cm, a generally symmetrical solidification front was obtained with concomitant improvement in the as-cast surface.

Of course, the parameters of casting speed and cooling probe insertion distance for achievement of generally symmetrical solidification will vary with the chemistry of the molten metal or alloy being solidified, the initial temperature thereof, the size of the cast product to be produced and other factors. The precise cooling probe positions required for a given set of casting parameters can be readily determined by empirical analysis by those skilled in the art.

Figure 10:
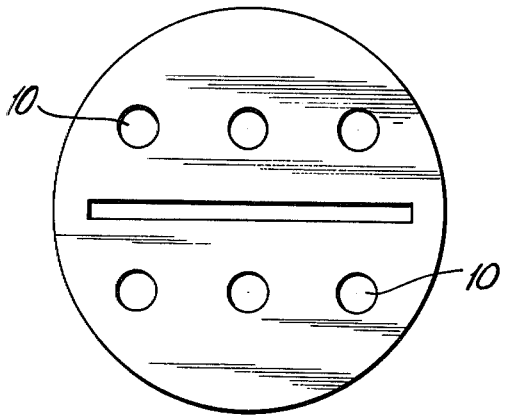
FIG. 10 is an end elevation of a mold body of the invention for producing a solidified product with a rectangular cross-section.

The present invention is particularly useful in producing continuously cast nonferrous strip, such as in the mold body shown in FIG. 10 of the aforementioned U.S. patent application Ser. No. 958,774 now U.S. Pat. No. 4,216,818 filed Nov. 8, 1978 having a solidification chamber shaped to produce strip, to minimize the risk of edge cracking which is a characteristic occurrence in such horizontal continuous strip casting.

Figure 8:
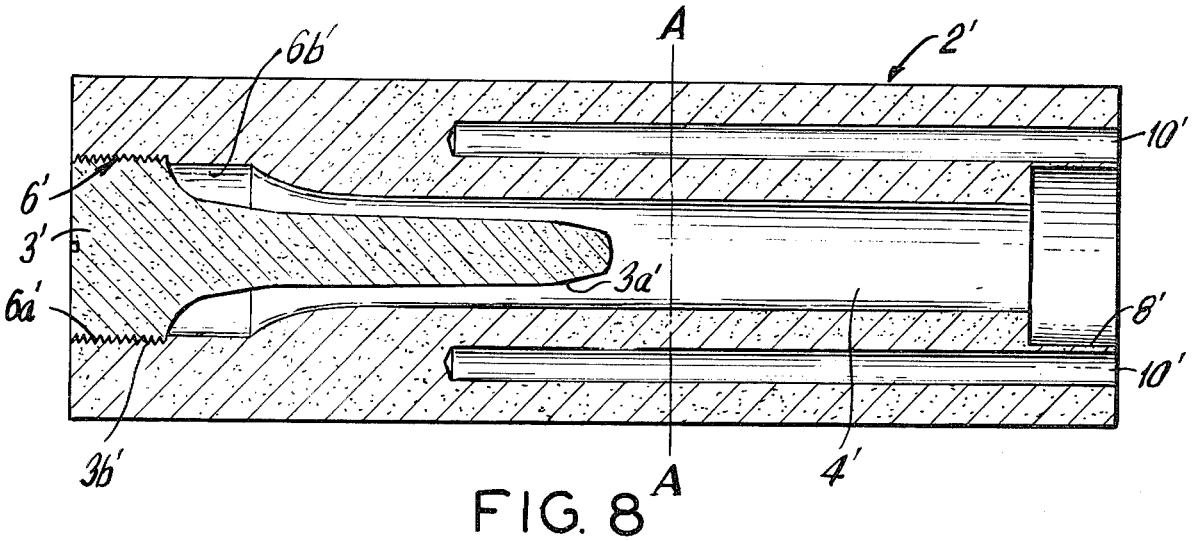
FIG. 8 is a cross-section through a mold body having a mandrel therein to produce hollow cast shapes.
Figure 9A:
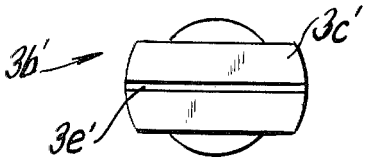
FIG. 9*a* and 9*b* are end elevations of useful mandrels.
Figure 9B:
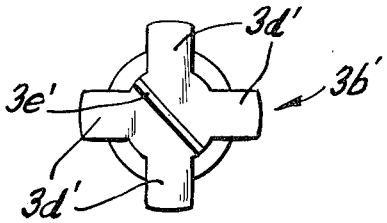

FIGS. 8 and 9 illustrate another embodiment of the invention adapted for continuously casting hollow shapes such as tubes and the like. The mold body 2' is similar in most respects to that described hereinabove, the major difference being associated with inlet end 6' which is extended in length to include a threaded first chamber 6a' and an unthreaded second chamber 6b' having an inner end tapering into solidification chamber 4'. A refractory (graphite) mandrel 3' is shown with its tapered end 3a' suspended in the solidification chamber and threaded end 3b' screwed into the first chamber 6a' of the inlet end. FIGS. 9a and 9b show alternative versions of the threaded mandrel end 3a' each of which allows molten metal from the crucible (now shown) to enter the solidification chamber. It is apparent that molten metal can readily flow around the projecting tongue 3c' in FIG. 9a and radial spokes 3d' in FIG. 9b into chamber 6b' and then into solidification chamber 4'. As shown, a slot 3e' is provided in the threaded end for a screwdriver or like tool.

In operation, symmetry of solidification around the tapered end of the mandrel 3a' is ensured by adjustment of the cooling probe insertion pattern as described hereinabove. Of course, this ensures symmetry of the hole produced in the cast shape. It will be apparent to those skilled in the art that the size of the longitudinal hole or bore produced through the cast shape can be varied as desired by moving the cooling probes into or out of the cooling bores to position the solidification front first at one location along the mandrel length and then at another location of different diameter or size. Hollow cast shapes with different bore sizes can thereby be produced without having to change mandrels.

A problem encountered in the past in continuously casting hollow shapes has been that metal solidifies around the mandrel during periods when casting is stopped and that this solidified metal oftentimes fractures the mandrel due to shear loads on the graphite when casting is restarted. This problem is readily solved in the present invention. Namely, prior to restart of casting, the probe insertion distance is decreased (probes withdrawn) to a position where the solidification front is moved to the right of the tapered end of the mandrel, e.g., line A—A, so that only molten metal is around the mandrel and a solid cast shape is initially produced. Sometimes thereafter, the probe insertion distance is increased (probes pushed in) in the preselected pattern to cause a symmetrical solidification front to be formed around the mandrel and the production of the desired hollow cast shape. Since no solidified metal is present around the mandrel upon restart, fracturing of the mandrel is minimized. These adjustments, i.e., probes withdrawal and then insertion can be repeated whenever casting is to be restarted.

While the invention has been explained by a detailed description of certain specific embodiments, it is understood that various modifications can be made in any of them within the scope of the appended claims which are intended to also include equivalents of such embodiments.

I claim:

1. In a horizontal continuous casting process wherein molten metal is continuously passed through a mold body having a substantially horizontal solidification chamber extending interiorly along the length thereof with an inlet end for receiving molten metal from a source and an outlet end through which solidified metal exits, the steps of:

(a) providing a plurality of cooling bores in the mold body spaced around the periphery of the solidification chamber from the bottom to the top thereof, each cooling bore having an open end on the outlet end of the mold body and extending toward the inlet end to define a peripheral cooling section adjacent said outlet end; and (b) inserting an elongated cooling probe into the open end of each cooling bore to provide cooling to said peripheral cooling section with the cooling probe insertion distance into the bores increasing from the bottom to the top of the mold body such that a liquid/solid solidification front which intersects the top and bottom of said chamber at approximately the same location along its length is established in the molten metal, whereby hot tears, fissures and other surface defects resulting from asymmetric solidification of the bottom portion of molten metal ahead of the top portion are reduced.

2. The process of claim 1 wherein the cooling probe insertion pattern in the cooling bores is such that a liquid/solid solidification front which is substantially symmetrical to a central, longitudinal axis through the solidication chamber is established in the molten metal.

3. The process of claim 2 wherein the molten metal is passed through a cylindrical solidification chamber.

4. The process of claim 1 wherein the molten metal is passed through a solidification chamber shaped to cast strip, whereby establishment of said solidification such that it intersects the top and bottom of said chamber at approximately the same location along the chamber minimizes edge cracking of the solidified strip.

5. The process of claim 1 wherein a mandrel is suspended in the solidification chamber of the mold body and the solidification front is formed around said mandrel to produce a hollow cast shape.

6. The process of claim 5 wherein the mandrel has a decreasing cross-section along its length toward the mold outlet end, and the solidification front is established first at one location along the mandrel length and then another by adjusting the insertion distances of the cooling probes to produce cast shapes with different size bores extending therethrough.

7. The process of claim 5 wherein casting is stopped and then restarted after molten metal has solidified around the mandrel, including the further steps of initially upon restart decreasing the cooling probe insertion distance to position the solidification front past the mandrel toward the outlet end of the mold body so that only molten metal surrounds the mandrel and minimizes fracturing thereof, a solid cast shape being produced, and then of increasing the cooling probe insertion distance to locate the solidification front around the mandrel to produce a hollow cast shape.

8. A mold assembly for horizontally continuously casting molten metal comprising:

(a) a mold body having a substantially horizontal solidification chamber therethrough with an inlet end for receiving molten metal from a molten metal source and an outlet end through which solidified metal exits and having a plurality of longitudinal cooling bores spaced around the solidification chamber from the bottom to the top thereof, the cooling bores each having an open end on the outlet end of the mold body and extending only partially therethrough toward the inlet end to define an insulating section adjacent said inlet end to minimize heat removal from said molten metal source and a peripheral cooling section adjacent said outlet end, and (b) a plurality of elongated cooling probes each of which is inserted into the open end of a cooling bore to provide cooling to said peripheral cooling section with the cooling probe insertion distance into the bores increasing from the bottom to the top of the mold so that a liquid/solid solidification front which intersects the top and bottom of said chamber at approximately the same location along its length is established in the molten metal, whereby hot tears, fissures and other surface defects resulting from asymmetric solidification of the bottom portion of molten metal ahead of the top portion are reduced.

9. The mold assembly of claim 8 wherein said solidification chamber is a cylindrical bore.

10. The mold assembly of claim 9 wherein the cooling bores extend into the mold body substantially parallel to said solidification chamber.

11. The mold assembly of claim 10 wherein six cooling bores are spaced 60° apart around the circumference of the solidification chamber and the mold body is oriented such that two bores are coplanar on the bottom, two bores are coplanar on the sides, and two bores are coplanar on the top of the mold body during casting.

12. The mold assembly of claim 8 wherein said solidification chamber is shaped to cast strip.

13. The mold assembly of claim 8 wherein a mandrel is suspended in the solidification chamber of the mold body so that a hollow cast shape is produced.

14. A mold assembly for horizontally continuously casting molten metal into a hollow shape, comprising:

(a) a mold body having a substantially horizontal solidification chamber therethrough with an inlet end for receiving molten metal from a molten metal source and an outlet end through which solidified metal exits and having a plurality of longitudinal cooling bores spaced around the solidification chamber from the bottom to the top thereof, the cooling bores each having an open end on the outlet end of the mold body and extending only partially therethrough toward the inlet end to define an insulating section adjacent said inlet end to minimize heat removal from said molten metal source and a peripheral cooling section adjacent said outlet end, (b) a mandrel suspended in the solidification chamber of said mold body, and (c) a plurality of elongated cooling probes each of which is inserted into the open end of a cooling bore to provide cooling to said peripheral cooling section with the cooling probe insertion distance into the bores increasing from the bottom to the top of the mold so that a symmetrical liquid/solid solidification front is established around the mandrel.

15. The mold assembly of claim 14 wherein the inlet end of the solidification chamber is threaded and one end of the mandrel includes threaded portions to threadably engage the inlet end and suspend the mandrel in said chamber, said one end of the mandrel also including molten metal access means to permit flow of metal from said source into said chamber.

16. The mold assembly of claim 14 wherein the mandrel includes a decreasing cross-section along its length toward the mold outlet end.

* * * * *